US005431782A

United States Patent [19]

Cassat

[11] Patent Number: 5,431,782

[45] Date of Patent: Jul. 11, 1995

[54] SYNTHETIC PAPERS BASED ON THERMALLY STABLE FIBRES, PULP AND BINDER AND PROCESS FOR OBTAINING THEM

[75] Inventor: Robert Cassat, Ternay, France

[73] Assignee: Rhone Poulenc Fibres, Lyons, France

[21] Appl. No.: 165,864

[22] Filed: Dec. 14, 1993

Related U.S. Application Data

[63] Continuation of Ser. No. 993,033, Dec. 18, 1992, abandoned.

[30] Foreign Application Priority Data

Dec. 24, 1991 [FR] France ..... 91 16340

[51] Int. Cl.[6] ..... D21H 13/26

[52] U.S. Cl. ..... 162/145; 162/123; 162/146; 162/152; 162/156; 162/157.2; 162/157.3; 162/164.6; 162/168.2; 162/206

[58] Field of Search ..... 162/145, 146, 157.2, 162/157.3, 138, 157.1, 152, 156, 164.6, 168.2, 169, 206, 123

[56] References Cited

U.S. PATENT DOCUMENTS

| | | | |
|---|---|---|---|
| 4,316,002 | 2/1982 | Cassat et al. | 528/107 |
| 4,729,921 | 3/1988 | Tokarsky | 162/157.3 |
| 4,799,996 | 1/1989 | Cassat | 162/152 |
| 5,002,637 | 3/1991 | Toyoshima et al. | 162/157.3 |
| 5,053,474 | 10/1991 | Camberlin et al. | 528/87 |
| 5,176,794 | 1/1993 | Conner et al. | 162/152 |

FOREIGN PATENT DOCUMENTS

| | | | |
|---|---|---|---|
| 0010489 | 4/1980 | European Pat. Off. . | |
| 0366576 | 5/1990 | European Pat. Off. . | |
| 2-69530 | 3/1990 | Japan | 162/146 |

*Primary Examiner*—Peter Chin

*Attorney, Agent, or Firm*—Stevens, Davis, Miller & Mosher

[57] ABSTRACT

The present invention relates to a reactivable paper and to a process for obtaining it.

The paper consists of fibres with a heat resistance ≧180° C., bonded together by means of a fibrous binder composed of polyamide or aromatic polyester pulp and of a chemical binder consisting of a polyether-imide of an aromatic polyester or of a resin of polyimide type, with a particle size smaller than 100 μm, a softening point of between 50° and 200° C., and a degree of cross-linking of between 0.025 and 0.25. The weight proportion of fibres in the finished paper is generally preferably between 45 and 85%, that of the fibrous binder between 5 and 20%, that of the chemical binder between 10 and 50%.

The papers are obtained by a wet route and find wide applications as a function of the degree of conversion of the resin, for example as a dielectric.

23 Claims, No Drawings

SYNTHETIC PAPERS BASED ON THERMALLY STABLE FIBRES, PULP AND BINDER AND PROCESS FOR OBTAINING THEM

This application is a CONTINUATION of application Ser. No. 07/993,033, filed Dec. 18, 1992 abandoned.

The present invention relates to synthetic papers based on thermally stable fibres and thermally stable pulp and binder. It also relates to a process for obtaining such papers.

According to the present invention the term "paper" denotes nonwoven articles in the form of sheets, films, felts and generally any coherent fibrous structure involving no textile operation such as spinning, knitting or weaving. It denotes more specifically articles based on synthetic textile fibres obtained by a wet or papermaking route.

Attempts have been made for a long time to produce nonwoven fibrous structures based solely on fibres originating from synthetic polymers in order to endow these structures with good mechanical characteristics. However, the processes for obtaining paper on the usual papermaking machines are easy to carry out when cellulose fibres are involved, but less so when synthetic fibres are involved. In fact, the hydrophobic character of the latter makes them difficult to process because they fibrillate poorly and tend to agglomerate, forming "parcels", making useless the products which are thus obtained. To overcome this disadvantage, attempts have been made according to U.S. Pat. No. 2,999,788, to prepare particles of synthetic polymers or "fibrids" of a particular structure, which are capable of being employed with fibres based on synthetic polymers for the production of coherent fibrous structures by a papermaking route. However, the preparation of such fibrids, carried out by precipitation in a sheared medium is complicated and costly. Furthermore, these fibrids must remain in an aqueous medium to be usable directly. As a result, they cannot be isolated or conveyed easily, and this limits their use.

According to FR 2,163,383, attempts have also been made to prepare nonwoven articles consisting of a sheet of fibres based on a material which is infusible or which has a melting point higher than 180° C., the fibres being bonded together by means of a polyamide-imide binder, employed in a proportion of 5 to 150% of the weight of the dry fibres used. However, such nonwovens are obtained by a dry route, by carding in this case, and this makes such a process very costly and of little industrial interest. Furthermore, the impregnation of the resin is done in solution in a solvent, and this results in detrimental effects on the characteristics of the nonwovens.

To improve the feasibility of nonwoven sheets, attempts have also been made, according to FR 2,156,452, to prepare by a wet route nonwoven sheets of fibres consisting of material which is infusible or which has a melting point >180° C., bonded together with synthetic polymer.

While, in theory, these sheets can be obtained by a papermaking route, their industrial production is not possible in practice: in fact, the mixture of synthetic fibres and resin-based binder has no cohesion to make it capable of being handled and in particular such a mixture does not have sufficient cohesion to be capable of being prepared dynamically, for example on a commercial papermaking machine; such sheets can be produced only on laboratory apparatus of the "Franck mould" type, that is to say statically and noncontinuously, as follows from the examples.

It has now been found that it is possible easily to prepare papers based on essentially synthetic materials and fibres which are resistant to high temperatures by a traditional papermaking route, in an industrial and economical manner.

The present invention relates more particularly to reactivable papers consisting of fibres bonded to each other by means of a fibrous binder and of a chemical binder,the fibres being inorganic or synthetic fibres exhibiting a heat resistance ≧180° C., the fibrous binder being a pulp of an aromatic polyamide or polyester exhibiting a heat resistance ≧180° C. and a chemical binder chosen from the group consisting of a polyetherimide, an aromatic polyester and at least one polyimide resin obtained from an N,N'-bisimide of an unsaturated dicarboxylic acid, of general formula:

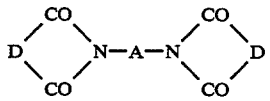

(I)

in which:

D denotes a divalent radical containing a carbon-carbon double bond,

A is a divalent organic radical containing 2 to 30 carbon atoms, and from a polyamine of general formula:

$$R(NH_2)X \qquad \text{(II)}$$

in which:

x is an integer equal to at least 2,

R denotes an organic radical of valency x, the quantity of bisimide being from 0.55 to 25 moles per —$NH_2$ molar group contributed by the polyamine, (ratio R of between 1 and 50), the resin exhibiting a particle size smaller than 100 μm and preferably ≦40 microns or even ≦15 microns, and being still in the state of prepolymer which has:

a) —a softening point of between 50° and 200° C., preferably between 90° and 150° C., b) —a free $NH_2$ unit content which is practically nil, c) —a degree of crosslinking, measured as the extractable bismaleimide content expressed in the form of unreacted double bond per 100 g of prepolymer, of between 0.025 and 0.25.

Preferably, the weight proportion of fibres in the finished paper is between 45 and 85%, the proportion of fibrous binder is between 5 and 20%, the proportion of chemical binder is between 10 and 50%, preferably 10 to 35%, the total proportion of fibres, binder and resin being 100% by weight.

The present invention also relates to a process for obtaining reactivable papers by introducing into water various constituents of the paper, the fibres, the pulp, the resin in powder form and optionally other desired fillers, and mixing these products in any appropriate apparatus with energetic agitation, followed by addition of a solution of a flocculating agent with gentle agitation in the case where the chemical binder is in powder form, formation of a papermaking web containing the above components, from which water is gradually removed by gravity and then under vacuum, optionally draining until most of the water has been removed, drying at a temperature between the ambient temperature and 100° C., densification of the web by any known means, and heat treatment at a temperature of between 50° and 275° C. to convert the resin to the desired degree of polycondensation. The solid constituents together represent a concentration of between 0.5 and 5% by weight.

The fibres employed in the invention may be chosen from the various fibres exhibiting the properties listed above. More precisely, they may be inorganic fibres such as glass fibres, carbon fibres, aluminium and zirconium oxide fibres, asbestos fibres, boron fibres; they may also be fibres originating from organic polymers among the polymers which are particularly suited for the manufacture of the papers according to the invention, having to withstand temperatures of 180° C., preferably ≧200° C. or higher for long periods: there may be mentioned polyamide-imides such as polytrimellitamide-imides or polyamides originating from wholly aromatic reactants or polyimides such as the polyimides obtained according to European Patent 0,119,185, known in the trade under the mark P84.

The polytrimellitamide-imides may be defined as comprising a plurality of units of formula:

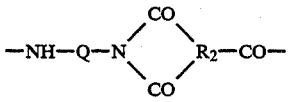

(III)

and/or with units of formula:

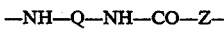

(IV)

in which:

the symbol Q denotes a divalent radical containing at least one benzene nucleus, $R_2$ denotes a trivalent aromatic radical, Z denotes a divalent, aromatic, aliphatic or cycloaliphatic radical.

The wholly aromatic polyamides may be defined as consisting of repeat units of formula:

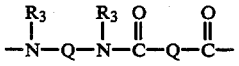

(V)

in which the various symbols Q, which are identical or different, have the meaning given above, and the symbols $R_3$, which are identical or different, denote a hydrogen atom or an alkyl radical containing from 1 to 4 carbon atoms.

It must be understood that in the manufacture of articles in accordance with the invention it is possible to employ a single type of fibres, or on the contrary, mixtures of fibres. These fibres are generally between 2 and 10 mm in length, preferably 3 to 7 mm, and their count, expressed in decitex is generally between 0.5 and 20. In theory it is possible to employ fibres of length greater than 10 mm but in practice longer fibres become tangled, requiring a larger quantity of water, and this makes the process more cumbersome and more complicated.

The fibrous binder employable according to the present invention originates from a polymer with heat resistance higher than or equal to 180° C., preferably ≧200° C., in the form of highly fibrillated pulp contributing the cohesion in the wet phase. The fibrous binder is in the form of very short fibres, of length which may vary, for example, between 0.1 and 5 mm, generally from 0.1 to 2 mm. The polymers which can be employed for the preparation of the pulp are fibrillable polymers based on entirely aromatic polyamides or polyesters. Aromatic polyamides are intended to mean the polyamides of general formula:

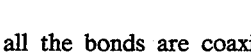

(vi)

in which all the bonds are coaxial or parallel, with Q=divalent radical containing at least one benzene nucleus. Aromatic polyamides of poly-para-phenylene terephalamide type are particularly suitable, for example that known in the trade under the mark "Twaron®"; wholly aromatic polyesters, crystallised, also fibrillate very well and can be employed in pulp form. The fibrous binder may be in the form of flock or felt still containing a certain proportion of water originating from their preparation.

The pulp has generally been obtained by starting with fibres of usual length, beaten or milled, in a known manner, in order to give it a large number of bonding points and thus increase its specific surface. Among synthetic fibres, only highly crystalline fibres can be fibrillated; this is the case with wholly aromatic polyamides and polyesters, but other highly crystalline polymers can be split along the axis of the fibres or can be fibrillated.

The chemical binder is chosen from the group consisting of:

a polyetherimide an aromatic polyester a heat-curable resin resistant to thermal stresses obtained by reaction of an N,N'-bisimide of an unsaturated dicarboxylic acid, of general formula;

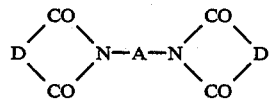

(VII)

in which:

D denotes a divalent radical containing a carbon-carbon double bond, and

A is a divalent radical containing at least 2 carbon atoms, with a diprimary diamine of general formula:

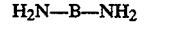

(VIII)

in which B denotes a divalent radical containing not more than 30 carbon atoms.

The symbols A and B may be identical or different and may denote a linear or branched alkylene radical containing fewer than 13 carbon atoms, a cycloalkylene radical with 5 or 6 carbon atoms in the ring, a heterocyclic radical containing at least one of the atoms O, N and S, a benzene or polycyclic aromatic radical; these various radicals may additionally carry substituents which do not give interfering reactions under the operating conditions. The symbols A and B may also include a number of benzene or alicyclic radicals connected directed via a divalent atom or group such as, for example, oxygen or sulphur atoms, alkylene groups containing from 1 to 3 carbon atoms and the groups $-NR_4-$, $-P(O)R_3-$, $-N=N-$, $-N=N-$; $-CO-O-$, $-SO_2-$, $\downarrow$ O $-SiR_3R_4-$, $-CONH-$, $-NY-CO-X-CO-NY-$, $-O-CO-X-CO-O-$,

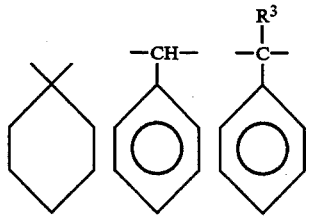

in which $R_3$, $R_4$ and Y denote an alkyl radical containing from 1 to 4 carbon atoms or a cycloalkyl radical with 5 or 6 carbon atoms in the ring, a benzene or polycyclic aromatic radical, and X denotes a linear or branched alkylene radical containing fewer than 13 carbon atoms, a cycloalkylene radical with 5 or 6 carbon atoms in the ring or a mono- or polycyclic arylene radical.

The radical D derived from an ethylenic anhydride of general formula:

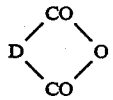

which may be, for example, maleic anhydride, citraconic anhydride, tetrahydrophthalic anhydride, itaconic anhydride and the products of Diels-Alder reaction between a cyclodiene and one of these anhydrides.

Among the N,N'-bisimides (I) which can be employed there may be mentioned:

N,N'-ethylenebismaleimide,
N,N'-hexamethylenebismaleimide,
N,N'-meta-phenylenebismaleimide,
N,N'-4,4'-diphenylmethanebismaleimide,
N,N'-4,4'-diphenyl ether bismaleimide,
N,N'-4,4'-diphenyl sulphone bismaleimide,
N,N'-4,4'-dicyclohexylmethanebismaleimide,
N,N'-α,α'-4,4'-dimethylenecyclohexanebismaleimide,
N,N'-meta-xylylenebismaleimide,
N,N'-4,4'-diphenylcyclohexanebismaleimide.

As examples of diamines (II) which can be employed there may be mentioned:

4,4'-diaminodicyclohexylmethane,
1,4'-diaminocyclohexane,
2,6-diaminopyridine,
meta-phenylenediamine,
para-phenylenediamine,
b 4,4'-diaminodiphenylmethane,
2,2-bis(4-aminophenyl)propane,
benzidine,
4,4'-diaminophenyl ether,
4,4'-diaminophenyl sulphide,
4,4'-diaminodiphenyl sulphide,
4,4'-diaminodiphenyl sulphone,
bis(4-aminophenyl)diphenylsilane,
bis(4-aminophenyl)methylphosphine oxide,
bis(3-aminophenyl)methylphosphine oxide,
bis(4-aminophenyl)phenylphosphine oxide,
bis(4-aminophenyl)phenylamine,
b 1,5-diaminonaphthalene,
meta-xylylene diamine,
para-xylylene diamine,
1,1-bis(para-aminophenyl)phthalan,
hexamethylenediamine.

The quantities of N,N'-bisimide and of diamine are chosen so that the ratio:

$$\frac{\text{no. of moles of N,N'-bisimide (I)}}{\text{no. of moles of diamine (II)}}$$

is at least equal to 1; it is generally preferred, furthermore, that it should be lower than 50.

According to the present invention use is preferably made of a polyimide resin originating from the reaction between a bismaleimide such as N,N'-4,4'-diphenylmethanebismaleimide and a primary diamine such as 4,4'-diaminodiphenylmethane.

The polyimide resin is employed in the form of powder of small particle size; generally $\leqq 100$ μm and preferably less than $\leqq 40$ μm and even $\leqq 15$ μm, to obtain a good final homogeneity of the paper. It must be present incompletely crosslinked in the finished paper at the prepolymer stage. The prepolymer generally has a softening point of between 50° and 200° C., generally between 90° and 150° C. In addition it has a degree of crosslinking, measured as the extractable bismaleimide content expressed in the form of unreacted double bond per 100 g of prepolymer, of between 0.025 and 0.25, a practically nil free amine content.

It is generally used in the form of dry powder or dispersion in an aqueous medium.

For economic reasons the polyimide resin is advantageously used in combination with an epoxy resin of bisphenol A type, in a proportion of 0 to 100% and preferably 25 to 75% of polyimide resin, that is 0 to 75% of epoxy resin, preferably 25 to 75% by weight.

The term reactivable paper implies a product in which the resin is incompletely polymerised while having sufficient cohesion for actual paper to be obtained.

When the chemical binder is a polyetherimide or an aromatic polyester, it is preferably employed in the form of fibres to promote bonding to the other fibres and the pulp, thus avoiding the flocculation stage.

It is also possible to employ a mixture of polyetherimide or of aromatic polyester and of polyimide resin in the desired proportions.

Polyether imides are high-performance polymers. Among them, it is possible to employ, for example, the product marketed under the mark Ultem 1010 by the General Electric Plastics company, which is in the form of fibres.

An aromatic polyester is intended to mean wholly aromatic polyesters which are polymers with liquid crystals characterised by straight polymer chains generally produced from at least one aromatic diacid such as terephthalic acid and from at least one diphenol. They have excellent unidirectional mechanical properties. Among the products which can be employed there may be mentioned, for example, the product known in the trade under the mark Xydar from the Dartco Manufacturing company or of mark Rhodester C. L. from the Rhône-Poulenc company.

The polyimide resin is preferably employed.

Such a paper can form part of the composition of many composite articles and in particular can be used in combination with other constituent elements, for example for the purpose of insulation and reactivated insitu to complete polymerisation. The reactivity of the paper is a function of the conversion of the polymeric binder, it being also possible for this conversion to be carried out at the exit of the papermaking machine by heat treatment to the desired level for the application.

The reactivable paper according to the invention can be employed for many applications, which are a function of certain essential elements such as the formulation and the degree of conversion of the resin.

As a function of their formulation:

A paper containing only the quantity of resin necessary to fill the porosity of the fibres will function as "spacer paper" to be inserted between two components to be insulated electrically; a paper very rich in resin and therefore capable of flowing when hot will function as "storage paper" the excess resin from which will bridge the gaps between the components to be insulated.

Paper of this type will be capable of acting as "reactive paper" acting as a hardener (because of the secondary and tertiary amine functional groups which it contains in respect of an in-situ input of epoxy resin in the case of an additional technique of insulation known as "dropwise"). In this case the prepolymer used in the papermaking stage will be essentially a polyimide prepolymer.

As a function of their degree of conversion:

A highly converted paper will be relatively rigid and usable in insulation for closing slots. A slightly converted paper will be flexible and usable in thermoforming.

An intermediately converted paper will have a slight flow under pressure and will be consequently usable for the production of composites (for example paper+film) without additional input of resin.

The variable conversion state also permits heat insulation-welding especially in the case of wrapping insulation.

Furthermore, the reactivable paper according to the invention offers considerable advantages from the viewpoint of management of a stock of intermediate products at the utilisation stage:

owing to the availability of "base paper" of low conversion, capable of receiving a complementary conversion varied by the user, as a function of the final use, owing to the formation of composites with basic weights per unit area to make available various necessary weights per unit area.

The mechanical characteristics of the paper naturally depend on the degree of conversion of the resin. The nearer the latter is to its final degree of crosslinking, the better will be the characteristics. Adjuvants or fillers can also be employed in various proportions depending on the desired properties, to improve some properties; for example, mica can be introduced to further increase the dielectric properties of such papers; besides good dielectric properties, the papers according to the invention have good mechanical properties which depend on the degree of conversion of the resin, in particular a high tensile strength. The good characteristics which the papers according to the invention exhibit are to a large extent due to a very uniform and homogeneous fine structure reflecting the very good distribution of the various constituents. This good homogeneity arises from a combination of selected factors, such as the proportion of the various raw materials, the nature and the length of the fibres employed and of the fibrous binder, the particle size of the resin and the method of preparation, as will be seen later.

The preparation of the papers according to the invention is carried out by a wet or papermaking route. According to this technique all the starting materials, including the fillers, are incorporated directly in a suitable apparatus called a "stack" by paper manufacturers. The raw materials present in the proportions and form indicated above are introduced in a divided state to make it easier to obtain a good dispersion. They are mixed in the presence of water with energetic agitation. Aluminium sulphate in solution can also be added at this stage to promote the dispersion. In the "stack" the solids content is approximately 1.5%; when the mixture has become homogeneous it is generally transferred into a storage apparatus known as a "chest" in which the pulp obtained is stored with gentle agitation; then in the case where the chemical binder is in powder form, a flocculating system is added to the pulp, still with gentle agitation. The flocculating system comprises, on the one hand, aluminium sulphate and, on the other hand a flocculant. Among the flocculants, a cationic flocculant based on acrylamide, known in the trade under the mark Praestol 611 BC from Stockhausen, which is effective.

The flocculating system ensures a physical binding of the resin particles onto the fibres and this makes it possible, if desired to employ resin particles of very small particle size and thus to obtain very homogeneous papers. If it is desired to improve the flocculation further, the particle size of the resin particles can be as small as 15 μm or less, but can also be larger (up to 50 or 10 μm). However, up until now it was difficult to employ resin particles as small as 15 μ or less because the resin particles were retained by the fibres only very slightly, even with a much larger particle size, with the result that a high proportion of the resin was removed with the water. This was the case in the process according to FR 2,156,452. The pulp is next taken up by any known means to feed the distribution table of a traditional papermaking machine. On arriving at the distribution table, the homogeneous pulp containing a high proportion of water spreads uniformly while the water is progressively removed, first of all by gravity and then forcibly by suction, for example by means of a device producing a vacuum.

The felt thus obtained is drained until most of the water has been removed then, after having been separated from the endless cloth, dried at a temperature between the ambient and 110° C. and then densified by any known means, for example by cold or hot calendering at a temperature between the ambient and 150° C. or by heat pressing. A number of passes through the densifying apparatus can be carried out so as to obtain the desired density, generally between 0.5 and 1 or even higher, depending on the desired mechanical characteristics. The papers thus obtained next undergo a heat treatment at a temperature of between 50° and 275° C. to modify the resin to the desired degree of polycondensation, which is a function of their ultimate use. In the case where a completely aromatic polyester or a polyether imide is employed, the heat treatment is carried out at a temperature close to the melting point to ensure fibre cohesion. It is also possible to work in a single stage by performing a calendering at high temperatures which can be up to 300° C.

The examples which follow are given by way of guidance.

EXAMPLE 1

The various constituents are introduced with energetic agitation into a papermaking stack containing 2000 1 of water:

7 kg of bismaleimide resin known in the trade under the mark Kerimid 613 in the form of powder of 15 μm particle size, 4 kg of pulp based on aromatic polyamide: polyparaphenylene terephthalamide, known in the trade under the mark Twaron® 1097 in the form of flock in which the length of the fibres is approximately between 0.1 and 1 mm, 20 kg of polyamide-imide fibres described in FR 2,079,785, with a length of 4 mm and count of 2.2 dtex, known in the trade under the mark Kermel.

As a result of the moisture of the various constituents, the weight composition of the mixture is the following 62.3% Kermel b 24.5% Kerimid 613 (with a softening point of approximately 85° C., with a practically nil free amine content and an extractable bismaleimide content of 0.20)

13.2% Twaron®1097.

The solids content in the stack is in the order of 1.5%.

2 liters of a 10% solution of aluminium sulphate are also introduced. When the mixture is quite homogeneous, it is transferred into the chest.

In the chest the gently agitated pulp is taken up by a bucket wheel to feed the distribution table of a papermaking machine. Just before it reaches the distribution table, and thus in an unagitated zone, where the motion of material is due only to its flow, an aqueous solution of flocculant (known in the trade under the mark Praestol 611 BC from Stockhausen) is introduced, and this promotes the binding of the K 613 powder to the fibres.

From the distribution table the pulp is transferred onto an endless cloth which constitutes the moulding machine. Over the first part, the dry material carried by a high proportion of water is distributed homogeneously while the water escapes under gravity through the cloth.

The drained pulp next runs over vacuum boxes which improve the removal of water and finally under a roll which densifies the wet pulp by slight pressure.

Thus moulded, the paper is separated from the endless cloth and directed into a drying oven ventilated with air at 100°-110° C.

After drying, the moulded paper has a substance of 136 g/m$^2$.

This paper may be calendered with heating up to 280° C. For example, at 270° C. its thickness after calendering is 175 μm, its density 0.750 g/cm$^3$ and its tensile strength 66 N/cm. In the case of calendering at room temperature, the same product has a thickness of 199 μm and a density of 0.66 g/cm$^3$ the tensile strength is then 7.5 N/cm.

EXAMPLES 2 to 4:

The following compositions are used in the way indicated in Example 1

| | 2 | 3 | 4 |
|---|---|---|---|
| Kermel fibres % | 86.4 | 75 | 65.4 |
| Twaron ® pulp % | 4.5 | 8.3 | 11.5 |
| Kerimid 613 resin | 9.1 | 16.7 | 23.1 |

After drying, the papers obtained are pressed hot under the following conditions:

Temperature: 270° C.

Pressure : 25 bars

Time : 1 minute

The characteristics of the hot-pressed paper are the following:

| | 2 | 3 | 4 |
|---|---|---|---|
| Substance g/m$^2$ | 119 | 122 | 130 |
| Thickness μm | 191 | 173 | 174 |
| Density kg/m$^3$ | 623 | 705 | 749 |
| Strength N/cm | 42.3 | 57.3 | 66.1 |
| Elongation % | 3.9 | 4.6 | 4.4 |

EXAMPLES 5 to 7

Another series of composition tests:

| | 5 | 6 | 7 |
|---|---|---|---|
| Kermel fibres % | 62 | 54.5 | 46.5 |
| Twaron ® pulp % | 13 | 15.5 | 18.5 |
| Kerimid 613 resin | 25 | 30 | 35 |

was pressed at 270° C. for 1 minute, but with a pressure of 60 bars.

The characteristics of the resulting papers are the following:

| | 5 | 6 | 7 |
|---|---|---|---|
| Substance g/m$^2$ | 143 | 133 | 140 |
| Thickness μm | 158 | 140 | 144 |
| Density kg/m$^3$ | 908 | 952 | 973 |
| Tensile strength N/cm | | | |
| travel direction | 104 | 107 | 98 |
| cross direction | 49 | 40 | 44 |
| Elongation % travel direction | 4.5 | 4.1 | 3.8 |
| Elongation % cross direction | 2.8 | 2.1 | 2.4 |

EXAMPLES 8 TO 10

By starting with the following compositions:

| | 8 | 9 | 10 |
|---|---|---|---|
| Split mica % | 60 | 60 | 53 |
| Kermel fibres % | 25 | 25 | 18 |
| Twaron ® pulp % | 5 | 5 | 9 |
| Kerimid 613 resin | 10 | 5 | 20 |
| Ciba Geigy bisphenol A epoxy resin 6099% | 0 | 5 | 0 |

and after pressing carried out at 26° C. for 1 minute at 25 bars the resulting papers have the following characteristics:

| | 8 | 9 | 10 |
|---|---|---|---|
| Substance g/m$^2$ | 154 | 157 | 151 |
| Thickness μm | 171 | 156 | 140 |
| Density kg/m$^3$ | 898 | 1 011 | 1 088 |

-continued

| | 8 | 9 | 10 |
|---|---|---|---|
| Strength N/cm | 27 | 60 | 57 |
| Elongation % | 1.75 | 3.82 | 3.77 |

The mechanical characteristics of the reactivable papers obtained according to Examples 1 to 10 are not the final characteristics capable of being obtained; they will be increased by any subsequent heat treatment when the paper is employed in a hot environment.

EXAMPLE 11 - with aromatic polyester (liquid crystals)

The various constituents are introduced with energetic agitation into a papermaking stack containing 2000 l of water:

3.5 kg of solid epoxy resin 6099 from Ciba-Geigy in the form of powder of particle size <50 μm 3.5 kg of bismaleimide resin known in the trade under the mark Kerimid 613 in the form of powder of 15 μm particle size, 2.1 kg of pulp based on aromatic polyester known in the trade under the mark Rhodester® CL from Rhône-Poulenc in the form of flock in which the length of the fibres is approximately between 0.1 and 1 mm, 21 kg of polyamide-imide fibres described in FR 2,079,785, with a length of 4 mm and count of 2.2 dtex, known in the trade under the mark Kermel®.

The weight composition of the mixture is the following:

69.75% Kermel 11.60% Kerimid 613 (with a softening point of approximately 85° C., with a practically nil free amine content and an extractable bismaleimide content of 0.20)

11.60% of epoxy resin 6099

7% of Rhodester CL in pulp form.

The solids content in the stack is of the order of 1.5%, reduced to 0.5% by addition of water when the dispersion is deemed sufficient.

2 liters of a 10% aluminium sulphate solution are also introduced. When the mixture is quite homogeneous, it is transferred into the pulp tower.

From the pulp tower the gently agitated pulp flows under gravity to feed the distribution table of a papermaking machine. Just before reaching the distribution table, and therefore in an unagitated zone, where the motion of material is due only to its flow, an aqueous solution of flocculant (known in the trade under the mark "Praestol 611 BC from Stockhausen) is introduced, and this promotes the binding of the powdered resins onto the fibres.

From the distribution table the pulp is transferred onto an endless cloth which constitutes the moulding machine. Over the first part the dry material carried by a high proportion of water is distributed homogeneously while the water escapes by gravity through the cloth.

The drained pulp then runs over the vacuum boxes which improve the removal of water and finally under a roll which densifies the moist pulp by slight pressure.

Thus moulded, the paper is separated from the endless cloth and dried on rolls at 100° C.–140° C.

After drying, the moulded paper has a density of 0.640 g/m$^3$.

This paper may be calendered hot, for example at 270° C. its thickness after calendering is 138 μm, its density 0.970 g/cm$^3$ and its tensile strength 105 N/cm in the case of a paper of substance 134 g/m$^2$. In the case of calendering at 295° C. the same product (substance 132 g/m$^2$) has a thickness of 137 μm and a density of 0.962 g/cm$^2$; the tensile strength is then 104 N/cm.

EXAMPLE 12

The various constituents are introduced with energetic agitation into a papermaking stack containing 2000 l of water:

6.9 kg of PEI 6 mm fibres spun by the AKZO company from Ultem PEI from General Electrics, 2.1 kg of pulp based on aromatic polyamide: polyparaphenylene terephthalamide known in the trade under the mark Twaron 1097 in the form of flock in which the length of the fibres is approximately between 0.1 and 1 mm, 21 kg of polyamide-imide fibres described in FR 2,079,785 with a length of 4 mm and count of 2.2 dtex, known in the trade under the mark Kermel.

The weight composition of the mixture is the following:

70% Kermel b 23% of PEI fibres b 7% of Twaron 1097.

The solids content in the stack is of the order of 1.5%. It is reduced to 0.5% by addition of water when the dispersion is deemed sufficient.

When the mixture is quite homogeneous, it is transferred into the pulp tower.

From the pulp tower, the gently agitated pulp flows under gravity to feed the distribution table of a papermaking machine.

From the distribution table the pulp is transferred onto an endless cloth which constitutes the moulding machine. Over the first part the dry material carried by a high proportion of water is distributed homogeneously while the water escapes under gravity through the cloth.

The drained pulp then passes over vacuum boxes which improve the removal of water, and finally under a roll which densifies the moist pulp by slight pressure.

Thus moulded, the paper is separated from the endless cloth and dried on two rolls of 2.5 m diameter at 100° C.–140° C.

After drying, the moulded paper has a density of 125 g/m$^3$.

This paper can be calendered hot, for example, at 270° C. its thickness after calendering is 186 μm, its density 0,665 g/cm$^3$ and its tensile strength 90 N/cm. In the case of calendering at 295° C., the same product has a thickness of 154 μm and a density of 0,812 g/cm$^3$; the tensile strength is then 97.5 N/cm.

I claim:

1. Reactivable papers comprising fibers bonded to each other by means of a fibrous binder and of polymer binder without further coating, said reactivable papers comprising at least 45% by weight of inorganic or synthetic fibers exhibiting a heat resistance ≧180° C., at least 5% by weight of fibrous binder, and at least 10% by weight of polymer binder, said fibrous binder being a pulp of a wholly aromatic polyimide or polyester exhibiting a heat resistance ≧180° C., said polymer binder being chosen from the group consisting of a polyetherimide, a polyester and at least one resin obtained from an N,N'-bisimide of unsaturated dicarboxylic acid, of general formula:

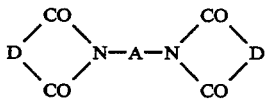

(I)

in which:

D denotes a divalent radical containing a carbon-carbon double bond,

A is a divalent organic radical containing 2 to 30 carbon atoms, and from a polyamine of general formula:

$R(NH_2)x$ (II)

in which:

x is an integer equal to at least 2,

R denotes an organic radical of valency x, and mixtures thereof, the quantity of bisimide being from 0.55 to 25 moles per $—NH_2$ molar group contributed by the polyamine, (ratio R of between 1 and 50), the resin exhibiting a particle size smaller than 100 microns and being still in the prepolymer state which has:

a)—a softening point of between 50° and 200° C., b)—a free $NH_2$ unit content which is practically nil, c)—a degree of crosslinking, measured as the extractable bismaleimide content expressed in the form of unreacted double bond per 100 g of prepolymer, of between 0.025 and 0.2, the total of the inorganic or synthetic fibers, the fibrous binder and polymer binder being 100%.

2. The papers according to claim 1, consisting of:

a weight proportion of fibers in the finished paper of between 45 and 85%, a proportion of fibrous binder of between 5 and 20%, and a proportion of polymer binder of between 10 and 50% with the total weight proportion being 100%.

3. The papers according to claim 1, wherein the fibers employed are polyamide-imide fibers.

4. The papers according to claim 1, wherein the fibers employed are aromatic polyamide fibers.

5. The papers according to Claim 1, wherein the fibers employed have a length of between 2 and 10 mm.

6. The papers according to claim 1, wherein the fibrous binder is a pulp of poly-paraphenylene terephthalamide.

7. The papers according to claim 1, wherein the polymer binder is a resin produced by the reaction of N,N'-4,4'-diphenylmethanebismaleimide and of bisamino(4-phenyl)methane.

8. The papers according to claim 1, wherein the particle size of the resin is smaller than or equal to 40 microns.

9. The papers according to claim 1, wherein the particle size of the resin is smaller than or equal to 15 microns.

10. The papers according to claim 1, wherein the fibrous binder is a polyimide resin employed jointly with an epoxy resin, in a proportion of 0 to 75% of epoxy resin.

11. The papers according to claim 10, wherein the epoxy resin is present in a proportion of 25 to 50%.

12. The papers according to claim 1, including mica in the form of filler.

13. A composite article composed of the papers according to claim 1.

14. The papers according to claim 1, including a flocculating agent.

15. A process for obtaining reactivable papers comprising fibers bonded to each other by means of a fibrous binder and of a polymer binder without further coating, said reactivable papers comprising at least 45% by weight of inorganic or synthetic fibers exhibiting a heat resistance ≧180° C., at least 5% by weight of fibrous binder, and at least 10% by weight of polymer binder, said fibrous binder being a pulp of a wholly aromatic polyimide or polyester exhibiting a heat resistance ≧180° C., said polymer binder being chosen from the group consisting of a polyetherimide, a polyester and at least one resin obtained from an N,N'-bisimide of unsaturated dicarboxylic acid, of general formula:

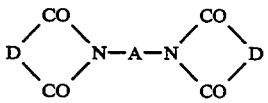

(I)

in which:

D denotes a divalent radical containing a carbon-carbon double bond,

A is a divalent organic radical containing 2 to 30 carbon atoms, and from a polyamine of general formula:

$R(NH_2)x$ (II)

in which:

x is an integer equal to at least 2,

R denotes an organic radical of valency x, and mixtures thereof, the quantity of bisimide being from 0.55 to 25 moles per $—NH_2$ molar group contributed by the polyamine, (ratio R of between 1 and 50), the resin exhibiting a particle size smaller than 100 microns and being still in the prepolymer state which has:

a)—a softening point of between 50° and 200° C., b)—a free $NH_2$ unit content which is practically nil, c)—a degree of crosslinking, measured as the extractable bismaleimide content expressed in the form of unreacted double bond per 100 g of prepolymer, of between 0.025 and 0.25, the total of the inorganic or synthetic fibers, the fibrous binder and polymer binder being 100%, comprising introducing said inorganic or synthetic fibers, said pulp and said polymer binder into water in the divided state, mixing the abovementioned fibers, pulp and polymer binder in an apparatus with energetic agitation, forming a papermaking web, removing most of the water from the web progressively under gravity and then under a vacuum, drying said web at a temperature of between the ambient temperature and 110° C., densifying the web and heat-treating the web at a temperature close to the melting point of the polymer binder to ensure the cohesion of the fibers.

16. The process according to claim 15, wherein the polymer binder is in fiber form.

17. The process according to claim 14, wherein the densification is carried out by calendering a temperature of between the ambient temperature and 150° C.

18. The process according to claim 17, wherein the calendaring and the heat treatment are carried out in a single stage at temperatures ranging up to 300° C.

19. A process for obtaining reactivable papers comprising fibers bonded to each other by means of a fibrous binder and of a polymer binder without further coating, said reactivable papers comprising at least 45% by weight of inorganic or synthetic fibers exhibiting a heat resistance ≧180° C., at least 5% by weight of fibrous binder, and at least 10% by weight of polymer binder, said fibrous binder being a pulp of a wholly aromatic polyimide or polyester exhibiting a heat resistance >180° C., said polymer binder being chosen from the group consisting of a polyetherimide, a polyester and at least one resin obtained from an N,N'-bisimide of unsaturated dicarboxylic acid, of general formula:

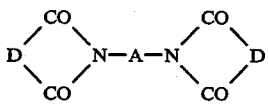

(I)

in which:

D denotes a divalent radical containing a carbon-carbon double bond,

A is a divalent organic radical containing 2 to 30 carbon atoms, and from a polyamine of general formula:

$$R(NH_2)x \quad \text{(II)}$$

in which:

x is an integer equal to at least 2,

R denotes an organic radical of valency x, and mixtures thereof, the quantity of bisimide being from 0.55 to 25 moles per —$NH_2$ molar group contributed by the polyamine, (ratio R of between 1 and 50), the resin exhibiting a particle size smaller than 100 microns and being still in the prepolymer state which has:

a)—a softening point of between 50° and 200° C., b)—a free $NH_2$ unit content which is practically nil, c)—a degree of crosslinking, measured as the extractable bismaleimide content expressed in the form of unreacted double bond per 100 g of prepolymer, of between 0.025 and 0.25, the total of the inorganic or synthetic fibers, the fibrous binder and polymer binder being 100%, comprising introducing into water in divided form said inorganic or synthetic fibers said pulp and said polymer binder produced from N,N'-bisimide and said polyamine, mixing said fibers, pulp and polymer binder in an apparatus with energetic agitation, adding a solution of a flocculating agent with gentle agitation to form a papermaking web, progressively removing most of the water under gravity and then under vacuum from the web, drying said formed web at a temperature between the ambient temperature and 110° C., densifying the web and heat-treating the web at a temperature between 50° and 275° C. to convert the resin to the desired degree of polycondensation.

20. The process according to claim 16, wherein the particle size of the resin particles is ≦15 μ.

21. The process according to claim 16, wherein 45 to 85% of inorganic or synthetic fibres, 5 to 20% of pulp and 10 to 50% of polyimide resin are introduced, the total of the 3 components being 100%.

22. The process according to claim 16, wherein the densification is carried out by calendering at a temperature of between the ambient temperature and 150° C.

23. The process according to claim 21, wherein the calendaring and the heat treatment are carried out in a single stage at temperatures ranging up to 300° C.

* * * * *